US008960938B2

(12) United States Patent
Yang

(10) Patent No.: US 8,960,938 B2
(45) **Date of Patent: *Feb. 24, 2015**

(54) ROTATIONAL GAME DECORATIVE DEVICE

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 94 days.

This patent is subject to a terminal disclaimer.

(21) Appl. No.: 13/798,168

(22) Filed: Mar. 13, 2013

(65) Prior Publication Data

US 2014/0268663 A1 Sep. 18, 2014

(51) Int. Cl.
*F21V 33/00* (2006.01)
*F21V 31/04* (2006.01)

(52) U.S. Cl.
CPC ..... *F21V 31/04* (2013.01)
USPC ..... 362/101; 362/253

(58) Field of Classification Search
USPC ..... 362/101, 96, 253
See application file for complete search history.

(56) References Cited

U.S. PATENT DOCUMENTS

| | | | | |
|---|---|---|---|---|
| 1,723,272 | A * | 8/1929 | Emma | 362/101 |
| 5,513,084 | A * | 4/1996 | Simpson | 362/284 |
| 7,473,002 | B1 * | 1/2009 | Chen | 362/35 |
| 8,695,247 | B1 * | 4/2014 | Yang | 40/442 |
| 2009/0135586 | A1 * | 5/2009 | Yang | 362/101 |

* cited by examiner

*Primary Examiner* — Julie Bannan
(74) *Attorney, Agent, or Firm* — Leong C. Lei

(57) ABSTRACT

A rotational game decorative device is disclosed, including: a aquatic lamp main body, a magnet-driven element, a buoy and a bottom base. The magnetic-driven element and the buoy are disposed inside the aquatic lamp main body. The top and the bottom of the buoy are disposed with a plurality of rotational plates disposed with interval. The bottom base is fixedly engaged to the aquatic lamp main body with a magnetic rotational axis for correspondingly attaching to the magnet-driven element, and driven by a driving element to rotate. When the magnetic rotational axis rotates, the magnet-driven element also rotates because of attachment to the magnetic rotational axis so as to wave the fluid inside the aquatic lamp main body, which leading to pushing to rotational plats to rotate the buoy.

4 Claims, 5 Drawing Sheets

ROTATIONAL GAME DECORATIVE DEVICE

(a) TECHNICAL FIELD OF THE INVENTION

The present invention generally relates to a rotational game decorative device, and more particularly to a decorative aquatic lamp with visual effects for displaying in an ambient, by waving the fluid to rotate and float a buoy disposed inside to achieve visual effects.

(b) DESCRIPTION OF THE PRIOR ART

In daily life, the home decoration utilizes decorative objects to improve visual esthetics, such as, household furnishing and other objects with decorative patterns. However, the majority of decorative pattern designs may only display statically for esthetic purpose. An aquatic lamp, on the other hand, can provide motions to display a variety of visual effects, for example, by manually shaking or using electricity to drive the glittering particles, pieces or decorative bits disposed inside the aquatic lamp to achieve a dynamic visual effect. Because different visual effects can be explored by disposing different elements inside the aquatic lamp, the development of aquatic lamp has become a specialty for ambient decorative manufacturers.

Therefore, it is desirable to devise an aquatic lamp able to dynamically display visual effects in addition to decorative capability so as to enhance the esthetics of the household.

SUMMARY OF THE INVENTION

The primary object of the present invention is to provide a rotational game decorative device, mainly including: an aquatic lamp main body, being a three-dimensional object formed by a light-transmittable hollow main body and a light-transmittable bottom cover, sealing a fluid with slightly high viscosity; a magnet-driven element, disposed inside the aquatic lamp main body, having a spherical bottom and radiating flip plates at the top; a buoy, having a surface forming a hollow cylinder disposed with a pattern, having a plurality of rotational plates disposed with interval at the top and the bottom of the buoy, the buoy being disposed inside the aquatic lamp main body; a bottom base, having an upward opening fixedly engaged to the aquatic lamp main body, being disposed with a magnetic rotational axis correspondingly attached to the magnet-driven element, the magnetic rotational axis being driven to rotate by a driving element.

As such, when the magnetic rotational axis is in rotation, the magnet-driven element also rotates because of attachment to the magnetic rotational axis so as to wave the fluid inside the aquatic lamp main body, which leads to pushing to rotational plats to rotate the buoy.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
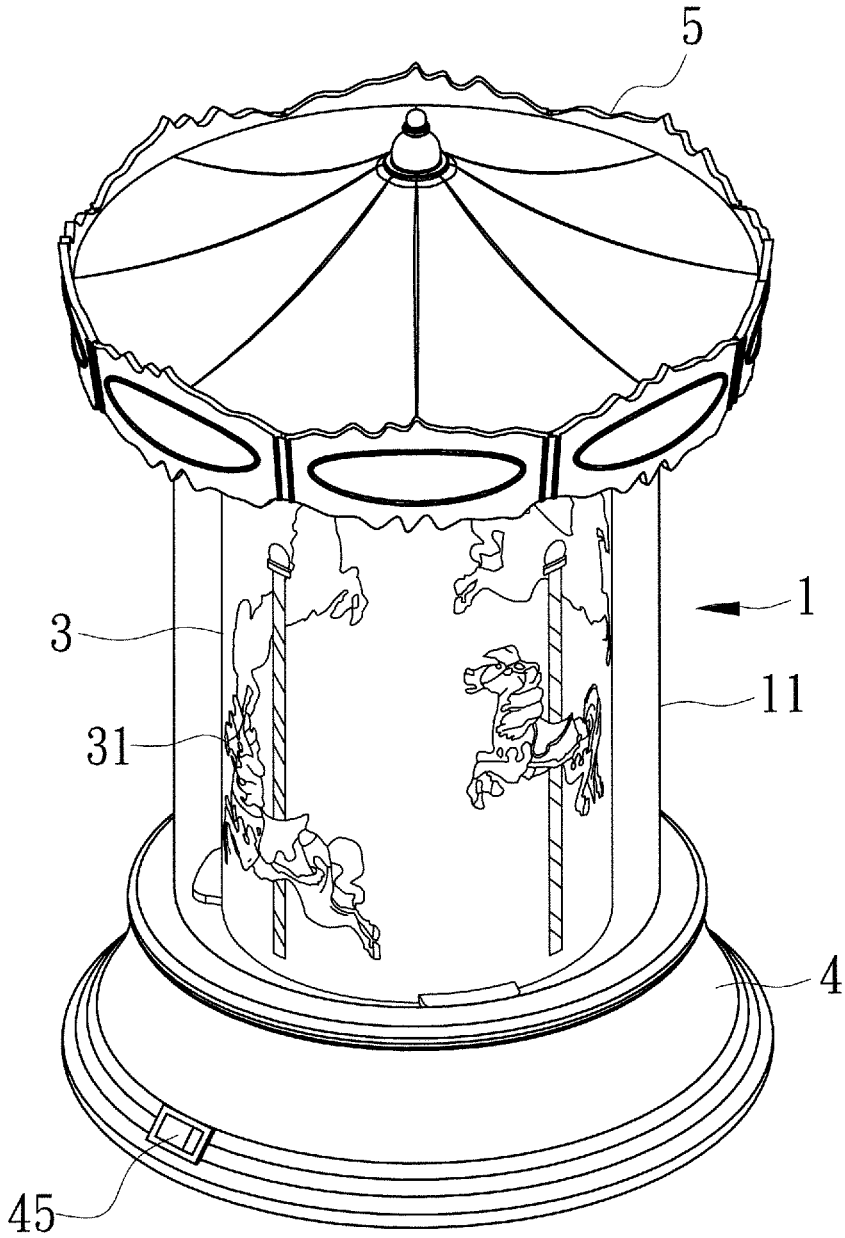
FIG. 1 shows a schematic view according to the invention.
Figure 2:
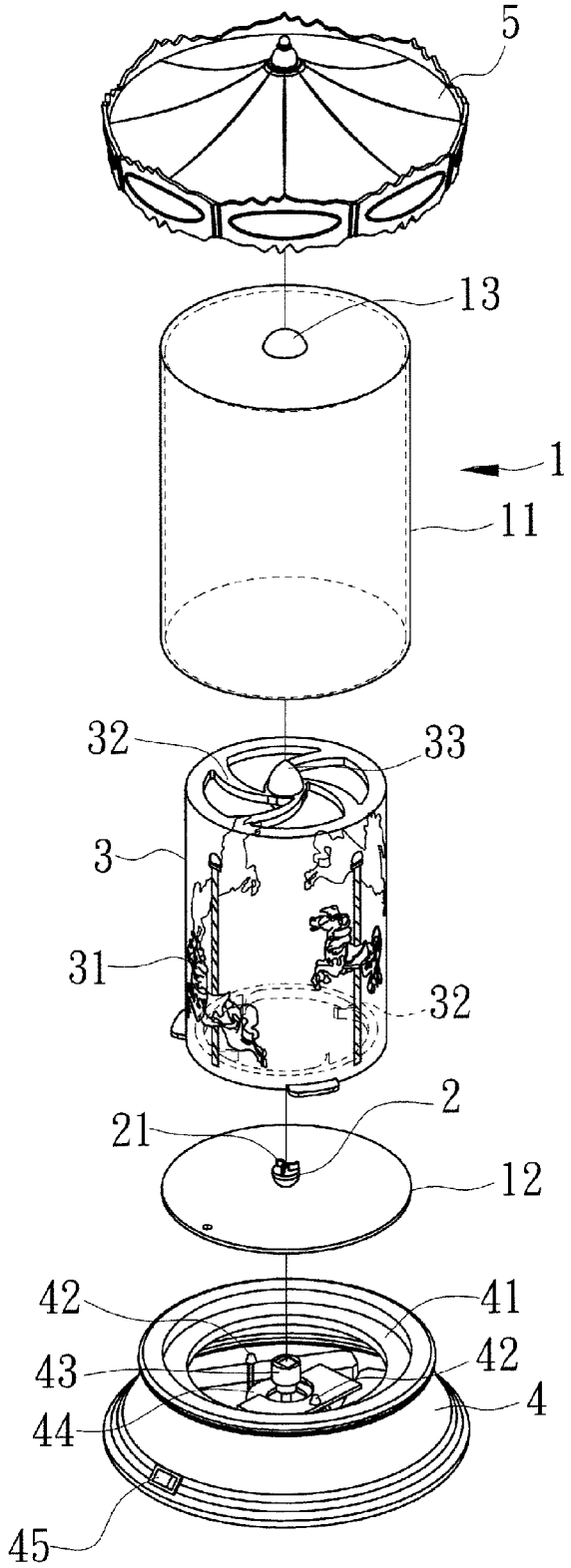
FIG. 2 shows a dissected view according to the invention.
Figure 3:
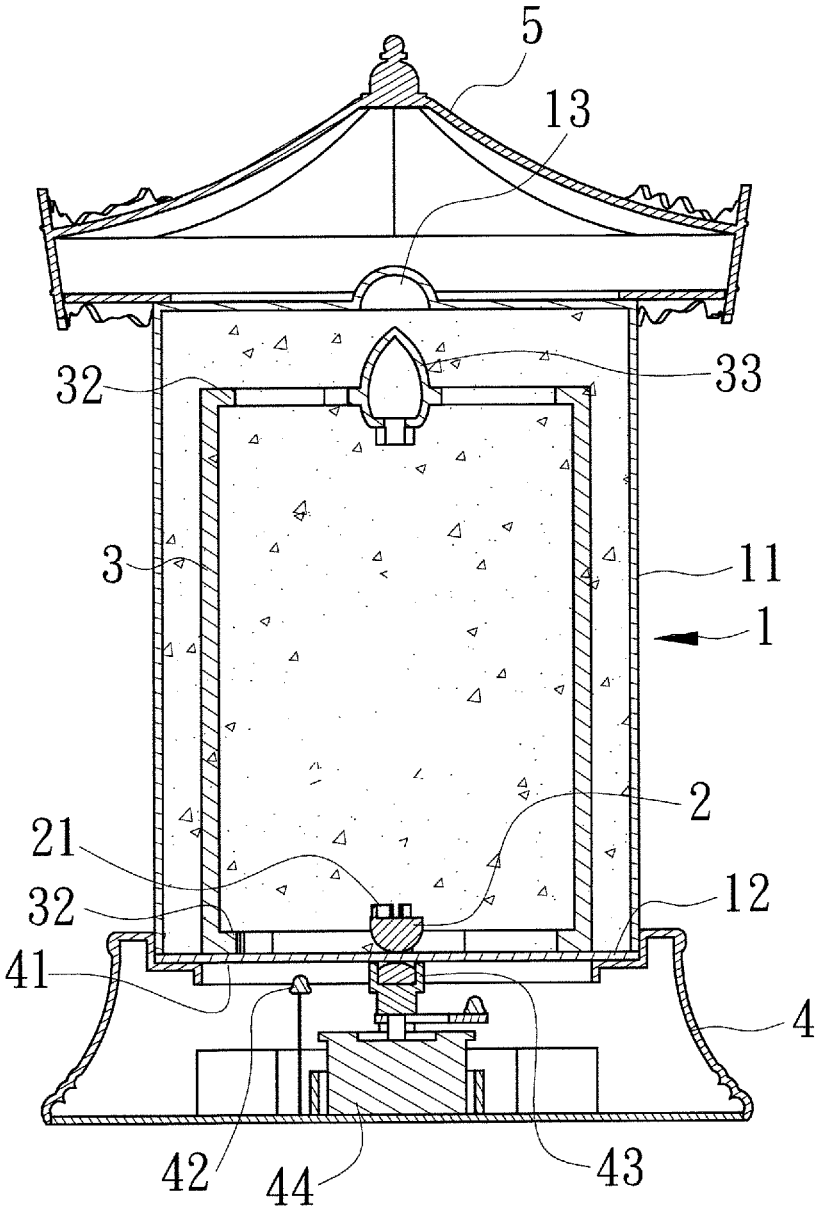
FIG. 3 shows a cross-sectional view according to the invention.

Referring to FIGS. 1-3, which are schematic view, dissected view and cross-sectional view of the present invention, respectively, the candle-shape decorative lamp mainly includes an aquatic lamp main body 1, a magnet-driven element 2, a buoy 3 and a bottom base 4. The aquatic lamp main body 1 is fixedly engaged to the top of the bottom base 4, with the magnet-driven element 2 and the buoy 3 being disposed inside the aquatic lamp main body 1.

The aquatic lamp main body 1 is a three-dimensional object formed by a light-transmittable hollow main body 11 and a light-transmittable bottom cover 12, sealing in a fluid with slightly high viscosity, doped with glittering particles or pieces. The main body 11 is disposed with an upward protruding hemispheric positioning trench 13 at the top.

The magnet-driven element 2 has spherical bottom and a flat top disposed with flip plates 21 arranged in radiation. The magnet-driven element 2 is disposed inside the aquatic lamp main body 1.

The buoy 3 is disposed inside the aquatic lamp main body 1, is hollow with a pattern 31 on the surface. In the present embodiment, the buoy 3 is made of transparent material with a skeleton top and a skeleton bottom. A plurality of rotational plates 32 is disposed with intervals in a radiating form from wall of the top and bottom. A top pillar is disposed at the top corresponding to the positioning trench 13.

The bottom base 4 has an upward opening 41 fixedly engaged to the aquatic lamp main body 1. Two light-emitting elements 42 are disposed inside the bottom base to correspond to the bottom cover 12 of the aquatic lamp main body 1 for projecting light onto the light-transmittable aquatic lamp main body 1 to enhance the visual esthetics. A magnetic rotational axis 43 is disposed inside the bottom base 4 correspondingly attached to the magnet-driven element 2. The magnetic force of the magnetic rotational axis 43 is from a magnet, preferably a powerful magnet. The magnetic rotational axis 43 is driven by a driving element 44 to rotate.

The present invention may further include a three-dimensional cover body 5. The cover body 5 is assembled and disposed to the top of the aquatic lamp main body 1, to form a monolithic shape with the aquatic lamp main body 1. In the present embodiment, the cover body 5, the aquatic lamp main body 1 and the bottom base 4, after assembly, form a rotational carousel game decorative lamp.

Figure 4:
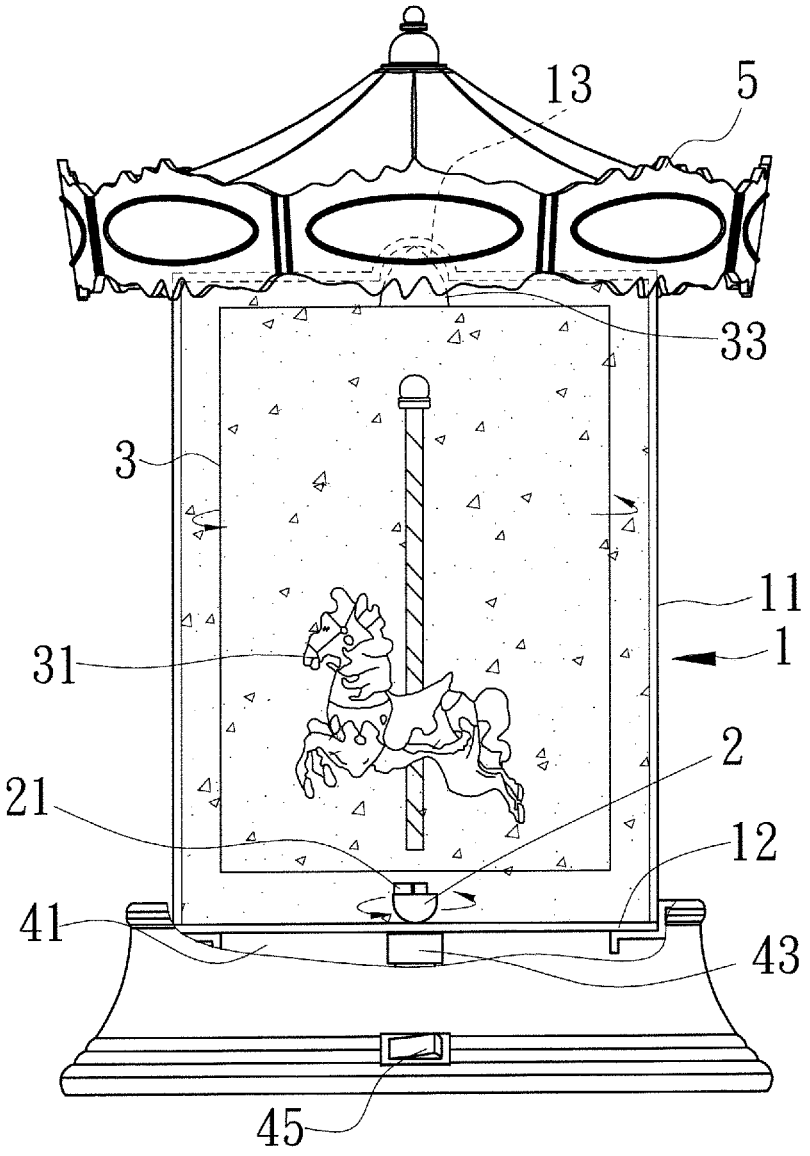
FIG. 4 shows a schematic planar view of operation according to the invention.
Figure 5:
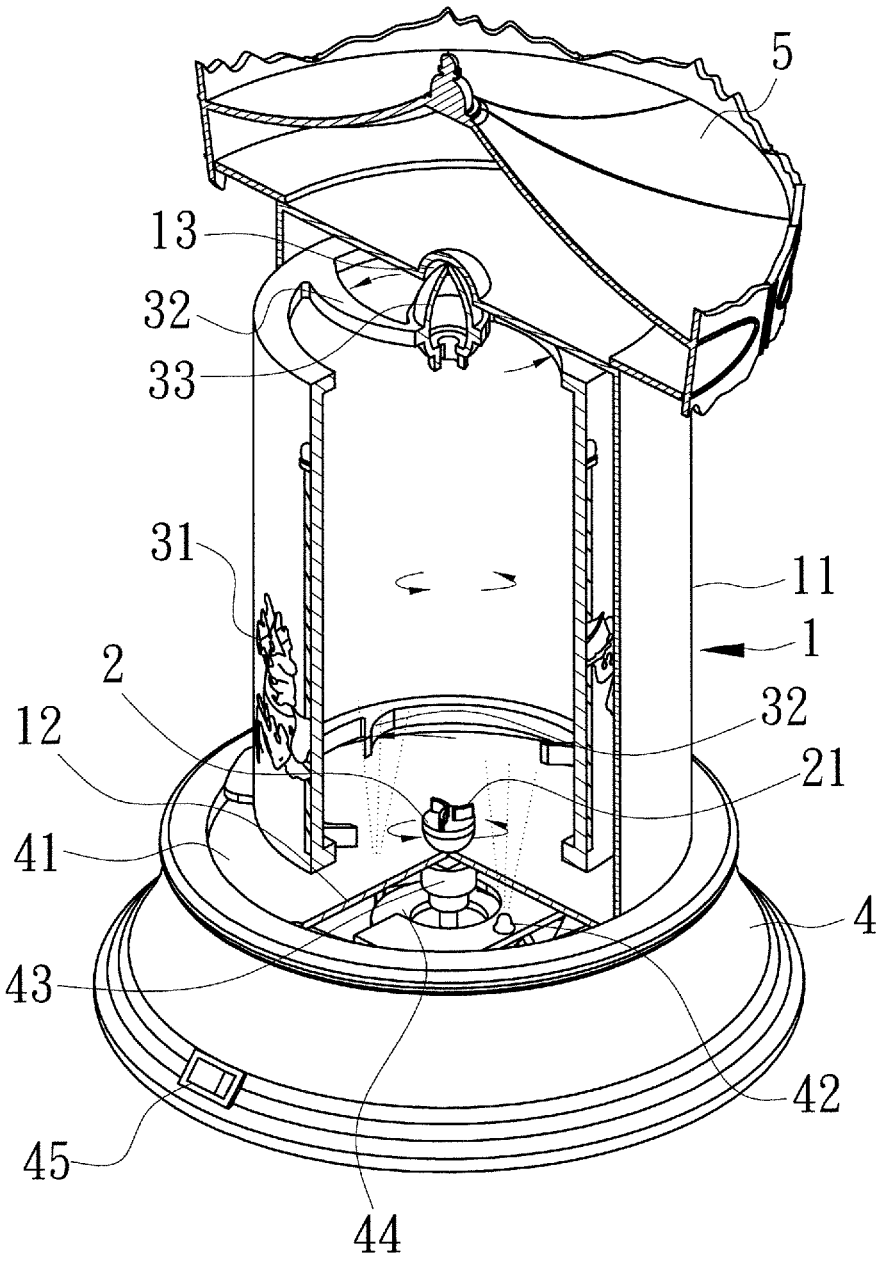
FIG. 5 shows a partial cross-sectional view according to the present invention.

Refer to FIG. 4 and FIG. 5. Because of the attachment of the magnetic rotational axis 43, the magnet-driven element 2 sinks at the bottom of the aquatic lamp main body 1, and the buoy 3 is carried by the force of the fluid inside the aquatic lamp main body 1 to stay floating, and using the top pillar 33 to fit the inside of the positioning trench 13 so as to limit the rational range of the buoy 3 inside the aquatic lamp main body 1.

In addition, the driving power for the light-emitting element 42 and the driving element 44 is controlled by a switch 45, and the power source can be corresponding battery or by other means of AC or DC, which is not within the scope of the present invention, and thus the detailed description is omitted here.

In the embodiment, the light-emitting element 42 can be designed as a light-emitting diode (LED), and is disposed correspondingly below the light-transmittable aquatic lamp main body 1, to provide a variety of light colors to further enhance the visual effect of the present invention.

As such, when the magnetic rotational axis 43 rotates, the magnet-driven element 2 also rotates due to the attachment to the magnetic rotational axis 43 so as to wave the fluid inside the aquatic lamp main body 1. The fluid, in turn, pushes the rotational plates 32 at the top and the bottom of the buoy 3 so that the buoy 3 also rotates by the dragging of the fluid to display dynamic visual effects.

The specific operation of the present invention can be described as follows. An electrical power drives the light-emitting element 42 to laminate and the driving element 44 to operate, and then the magnetic rotational axis 43 rotates due to the driving of the driving element 43. The magnet-driven element 2 also rotates due to the attachment to the magnetic rotational axis 43 and uses the flip plates to wave the fluid inside the aquatic lamp main body 1 to flow in the same direction and to disturb the glittering particles or pieces doped in the fluid to flow along. The flowing fluid pushes the rotational plates 32 disposed on the buoy 3 to rotate the buoy 3 so that the present invention can show a visual effect of a rotational carousel to further enhance the fun of the device.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and de ails of the device illustrated and in its operation can be made by those skilled in the art without departing in any way from the spirit of the present invention.

I claim:

1. A rotational game decorative device, comprising:

an aquatic lamp main body, being a three-dimensional object formed by a light-transmittable hollow main body and a light-transmittable bottom cover, sealing a fluid with slightly high viscosity;

a magnet-driven element, disposed inside the aquatic lamp main body, having a spherical bottom and radiating flip plates at the top;

a buoy, having a surface forming a hollow cylinder disposed with a pattern, having a plurality of rotational plates disposed with interval at the top and the bottom of the buoy, the buoy being disposed inside the aquatic lamp main body; and a bottom base, having an upward opening fixedly engaged to the aquatic lamp main body, being disposed with a magnetic rotational axis correspondingly attached to the magnet-driven element, the magnetic rotational axis being driven to rotate by a driving element;

wherein when the magnetic rotational axis being in rotation, the magnet-driven element also rotating because of attachment to the magnetic rotational axis so as to wave the fluid inside the aquatic lamp main body, which leading to pushing to rotational plats to rotate the buoy.

2. The rotational game decorative device as claimed in claim 1, wherein the aquatic lamp main body is disposed with a upward protruding hemispheric positioning trench and the top of the buoy is disposed with a corresponding top pillar.

3. The rotational game decorative device as claimed in claim 1, further comprising a three-dimensional cover body, assembled and disposed on top of the aquatic lamp main body to form a monolithic shape with the aquatic lamp main body.

4. The rotational game decorative device as claimed in claim 1, wherein the bottom base is disposed with at least a light-emitting element inside to correspond to the bottom of the aquatic lamp main body.

* * * * *